US009745096B2

(12) United States Patent
Coltri-Johnson et al.

(10) Patent No.: US 9,745,096 B2
(45) Date of Patent: Aug. 29, 2017

(54) SHIPPING AND DISPENSING CARTON

(71) Applicant: Graphic Packaging International, Inc., Atlanta, GA (US)

(72) Inventors: Andrea Coltri-Johnson, Sao Paulo (BR); Jean-Manuel Gomes, Acworth, GA (US); Edward W. Jones, Hiram, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

(21) Appl. No.: 15/374,352

(22) Filed: Dec. 9, 2016

(65) Prior Publication Data

US 2017/0088306 A1 Mar. 30, 2017

Related U.S. Application Data

(60) Division of application No. 14/990,373, filed on Jan. 7, 2016, now Pat. No. 9,546,015, which is a (Continued)

(51) Int. Cl.
*B65D 5/00* (2006.01)
*B65D 5/02* (2006.01)
(Continued)

(52) U.S. Cl.
CPC ..... *B65D 5/0085* (2013.01); *B31B 7/26* (2013.01); *B65D 5/0227* (2013.01); *B65D 5/445* (2013.01);
(Continued)

(58) Field of Classification Search
CPC .... B65D 5/0085; B65D 5/0227; B65D 5/445; B65D 5/4608; B65D 5/5253; B65D 71/36;
(Continued)

(56) References Cited

U.S. PATENT DOCUMENTS 499,655 A 6/1893 Clark
642,121 A 1/1900 Hildreth
(Continued)

FOREIGN PATENT DOCUMENTS

DE 2 320 190 11/1973
DE 36 27 019 A1 2/1988
(Continued)

OTHER PUBLICATIONS

European Search Report for EP 08 01 0412 dated Oct. 22, 2008.
(Continued)

*Primary Examiner* — Christopher Demeree
(74) *Attorney, Agent, or Firm* — Womble Carlyle Sandridge & Rice, LLP

(57) ABSTRACT

A carton for holding a plurality of articles. The carton comprises a first side panel, a bottom panel, a second side panel, a first top panel, and a second top panel. The bottom panel comprises a first portion and a second portion. The carton comprises a first proximal side end flap, a first distal side end flap, a second proximal side end flap, a second distal side end flap, a first bottom end flap foldably connected to the first portion of the bottom panel, and second bottom end flap foldably connected to the second portion of the bottom panel. The first distal side end flap is in face-to-face contact with the second distal side end flap, the first bottom end flap is in face-to-face contact with the first proximal side end flap, and the second bottom end flap is in face-to-face contact with the second proximal side end flap.

15 Claims, 17 Drawing Sheets

Related U.S. Application Data continuation of application No. 14/095,136, filed on Dec. 3, 2013, now Pat. No. 9,260,215, which is a division of application No. 11/549,355, filed on Oct. 13, 2006, now Pat. No. 8,622,280, and a continuation-in-part of application No. 11/524,574, filed on Sep. 21, 2006, now Pat. No. 8,827,144.

(60) Provisional application No. 60/726,408, filed on Oct. 13, 2005, provisional application No. 60/719,309, filed on Sep. 21, 2005.

(51) Int. Cl.

| | |
|---|---|
| ***B65D 5/44*** | (2006.01) |
| ***B65D 5/52*** | (2006.01) |
| ***B65D 5/468*** | (2006.01) |
| ***B65D 71/36*** | (2006.01) |
| ***B31B 7/26*** | (2006.01) |

(52) U.S. Cl.

CPC ..... *B65D 5/4608* (2013.01); *B65D 5/5253* (2013.01); *B65D 71/36* (2013.01); *B31B 2201/6008* (2013.01); *B31B 2217/0038* (2013.01); *B65D 2571/0066* (2013.01); *B65D 2571/00141* (2013.01); *B65D 2571/00444* (2013.01); *B65D 2571/00728* (2013.01); *B65D 2571/00814* (2013.01)

(58) Field of Classification Search

CPC ..... B65D 5/5445; B65D 5/542; B65D 5/66; B65D 2571/00864; B65D 2571/00574; B65D 2571/00567; B65D 2571/00814; B65D 5/18; B31B 7/26

USPC ..... 229/120.011, 146, 235, 120.09, 193

See application file for complete search history.

(56) References Cited

U.S. PATENT DOCUMENTS

| | | | |
|---|---|---|---|
| 1,503,161 | A | 7/1924 | Hornecker |
| 1,634,073 | A | 6/1927 | Labombarde |
| 1,656,919 | A | 1/1928 | Marsh |
| 1,762,704 | A | 6/1930 | Smith |
| 1,901,483 | A | 3/1933 | Ware, Jr. |
| 1,912,698 | A | 6/1933 | Forsman |
| 1,925,102 | A | 9/1933 | Levkoff |
| 1,951,408 | A | 3/1934 | Haven |
| 1,971,863 | A | 8/1934 | Lupton |
| 2,027,079 | A | 1/1936 | Weiss |
| 2,141,743 | A | 12/1938 | Ethridge |
| 2,145,430 | A | 1/1939 | New |
| 2,152,079 | A | 3/1939 | Mott |
| 2,196,243 | A | 4/1940 | Bensel |
| 2,290,971 | A | 7/1942 | King |
| 2,330,294 | A | 9/1943 | Leavitt et al. |
| 2,383,853 | A | 8/1945 | Guyer |
| 2,407,802 | A | 9/1946 | Stotter |
| 2,416,332 | A | 2/1947 | Lehman |
| 2,619,276 | A | 11/1952 | Gibbons |
| 2,643,589 | A | 6/1953 | Weiss |
| 2,679,349 | A | 5/1954 | Mullinix |
| 2,710,134 | A | 6/1955 | Schroeder et al. |
| 2,791,362 | A | 5/1957 | Nute |
| 2,852,177 | A | 9/1958 | Frasch |
| 2,875,938 | A | 3/1959 | Bramhill |
| 2,887,389 | A | 5/1959 | Linville |
| 2,909,312 | A | 10/1959 | Conerty |
| 2,933,228 | A | 4/1960 | Reynolds |
| 2,954,913 | A | 10/1960 | Rossman |
| 2,967,610 | A | 1/1961 | Ebert et al. |
| 2,990,992 | A | 7/1961 | Ellis |
| 3,002,613 | A | 10/1961 | Merkel et al. |
| 3,090,483 | A | 5/1963 | Altree et al. |
| 3,092,301 | A | 6/1963 | Selle |
| 3,094,266 | A | 6/1963 | Hoff |
| 3,157,342 | A | 11/1964 | Grady |
| 3,158,312 | A | 11/1964 | Daniel |
| 3,164,316 | A | 1/1965 | Wurster et al. |
| 3,199,763 | A | 8/1965 | Anderson |
| 3,265,283 | A | 8/1966 | Farquhar |
| 3,276,665 | A | 10/1966 | Rasmussen |
| 3,280,968 | A | 10/1966 | Craine |
| 3,434,648 | A | 3/1969 | Du Barry, Jr. |
| 3,653,495 | A | 4/1972 | Gray |
| 3,677,458 | A | 7/1972 | Gosling |
| 3,698,548 | A | 10/1972 | Stenzel et al. |
| 3,759,378 | A | 9/1973 | Werth |
| 3,786,914 | A | 1/1974 | Beutler |
| 3,884,348 | A | 5/1975 | Ross |
| 4,008,849 | A | 2/1977 | Baber |
| 4,059,220 | A | 11/1977 | Lorenz |
| 4,113,100 | A | 9/1978 | Soja et al. |
| 4,267,959 | A | 5/1981 | Gilbert |
| 4,519,538 | A | 5/1985 | Omichi |
| 4,558,785 | A | 12/1985 | Gordon |
| 4,586,643 | A | 5/1986 | Halabisky et al. |
| 4,742,917 | A | 5/1988 | Bornwasser |
| 4,760,952 | A | 8/1988 | Wachter et al. |
| 4,773,541 | A | 9/1988 | Riddell |
| 4,778,057 | A | 10/1988 | Allen et al. |
| 4,815,609 | A | 3/1989 | Kiedaisch |
| 4,865,187 | A | 9/1989 | Zullauf et al. |
| 4,886,160 | A | 12/1989 | Kligerman |
| 4,919,269 | A | 4/1990 | Wright et al. |
| 5,012,929 | A | 5/1991 | Roosa |
| 5,181,650 | A | 1/1993 | Hollander et al. |
| 5,222,660 | A | 6/1993 | Koss |
| 5,328,091 | A | 7/1994 | Koss |
| 5,505,372 | A | 4/1996 | Edson et al. |
| 5,699,957 | A | 12/1997 | Blin et al. |
| 5,783,030 | A | 7/1998 | Walsh |
| 5,842,576 | A | 12/1998 | Snow |
| 5,857,570 | A | 1/1999 | Brown |
| 5,881,884 | A | 3/1999 | Podosek |
| D412,114 | S | 7/1999 | Hansen |
| 5,921,398 | A | 7/1999 | Carroll |
| 5,927,498 | A | 7/1999 | Saam |
| 5,979,749 | A | 11/1999 | Bozich |
| D419,440 | S | 1/2000 | Hansen |
| 6,015,084 | A | 1/2000 | Mathieu et al. |
| 6,027,017 | A | 2/2000 | Kuhn et al. |
| 6,129,211 | A | 10/2000 | Prakken et al. |
| 6,135,289 | A | 10/2000 | Miller |
| 6,158,579 | A | 12/2000 | Rosenbaum |
| 6,386,369 | B2 | 5/2002 | Yuhas et al. |
| 6,419,152 | B1 | 7/2002 | Tokarski |
| 6,435,351 | B1 | 8/2002 | Gibb |
| 6,478,159 | B1 | 11/2002 | Taylor et al. |
| 6,510,982 | B2 | 1/2003 | White |
| 6,523,692 | B2 | 2/2003 | Gregory |
| 6,729,475 | B2 | 5/2004 | Yuhas et al. |
| 6,854,639 | B2 | 2/2005 | Walsh |
| 6,869,009 | B2 | 3/2005 | Sutherland et al. |
| 6,905,027 | B2 | 6/2005 | Galter |
| 6,913,189 | B2 | 7/2005 | Oliff et al. |
| 6,918,487 | B2 | 7/2005 | Harrelson |
| 6,935,557 | B2 | 8/2005 | Aubry et al. |
| 7,021,468 | B2 | 4/2006 | Cargile, Jr. |
| 7,201,714 | B2 | 4/2007 | Zoeckler et al. |
| 8,025,209 | B2 | 9/2011 | Garner |
| 8,196,805 | B2 | 6/2012 | Brand et al. |
| 8,622,280 | B2 | 1/2014 | Coltri-Johnson et al. |
| 8,827,144 | B2 | 9/2014 | Gomes et al. |
| 9,260,215 | B2 | 2/2016 | Coltri-Johnson et al. |
| 9,546,015 | B2 | 1/2017 | Coltri-Johnson et al. |
| 2001/0048022 | A1 | 12/2001 | Zoeckler |
| 2002/0170845 | A1 | 11/2002 | Oliff |
| 2003/0226879 | A1 | 12/2003 | Auclair et al. |
| 2005/0092649 | A1 | 5/2005 | Ford et al. |
| 2005/0167291 | A1 | 8/2005 | Sutherland |

(56) References Cited

U.S. PATENT DOCUMENTS

| | | | |
|---|---|---|---|
| 2005/0218203 | A1 | 10/2005 | Harrelson |
| 2006/0255106 | A1 | 11/2006 | Green |
| 2006/0266815 | A1 | 11/2006 | Coltri-Johnson et al. |

FOREIGN PATENT DOCUMENTS

| | | | |
|---|---|---|---|
| DE | 298 17 195 | U1 | 11/1998 |
| DE | 202 16 854 | U1 | 1/2003 |
| EP | 0 133 595 | A2 | 2/1985 |
| EP | 0 704 386 | A1 | 4/1996 |
| FR | 1.379.931 | | 12/1963 |
| FR | 2 882 032 | | 8/2006 |
| GB | 1 218 016 | | 1/1971 |
| WO | WO 98/31593 | | 7/1998 |
| WO | WO 03/082686 | A1 | 10/2003 |
| WO | WO 2004/063031 | A1 | 7/2004 |

OTHER PUBLICATIONS

International Search Report and Written Opinion for PCT/US06/039865 dated Feb. 25, 2008.
Annex to Form PCT/ISA/266 Communication Relating to the Results of the Partial International Search for PCT/US06/039865 dated Mar. 8, 2007.
International Search Report for PCT/US06/036818 dated Feb. 5, 2007.
Preliminary Amendment for U.S. Appl. No. 11/549,355 dated Jun. 3, 2008.
Office Action for U.S. Appl. No. 11/549,355 dated Oct. 1, 2009.
Response to Election of Species Requirement for U.S. Appl. No. 11/549,355 dated Nov. 2, 2009.
Office Action for U.S. Appl. No. 11/549,355 dated Feb. 18, 2010.
Amendment A and Response to Office Action for U.S. Appl. No. 11/549,355 dated May 18, 2010.
Office Action for U.S. Appl. No. 11/549,355 dated Aug. 11, 2010.
Request for Continued Examination (RCE) Transmittal for U.S. Appl. No. 11/549,355 dated Nov. 10, 2010.
Amendment B and Response to Office Action for U.S. Appl. No. 11/549,355 dated Nov. 10, 2010.
Office Action for U.S. Appl. No. 11/549,355 dated May 14, 2013.
Amendment C and Response to Office Action for U.S. Appl. No. 11/549,355 dated Jul. 30, 2013.
Notice of Allowance and Fee(s) Due for U.S. Appl. No. 11/549,355 dated Sep. 3, 2013.
Part B—Fee(s) Transmittal for U.S. Appl. No. 11/549,355 dated Dec. 3, 2013.
Issue Notification for U.S. Appl. No. 11/549,355 dated Dec. 18, 2013.
Office Action for U.S. Appl. No. 14/095,136 dated Apr. 16, 2015.
Response to Election of Species for U.S. Appl. No. 14/095,136 dated May 15, 2015.
Office Action for U.S. Appl. No. 14/095,136 dated Jun. 4, 2015.
Amendment A and Response to Office Action for U.S. Appl. No. 14/095,136 dated Aug. 27, 2015.
Notice of Allowance and Fee(s) Due for U.S. Appl. No. 14/095,136 dated Oct. 8, 2015.
Part B—Fee(s) Transmittal for U.S. Appl. No. 14/095,136 dated Jan. 7, 2016.
Issue Notification for U.S. Appl. No. 14/095,136 dated Jan. 27, 2016.
Office Action for U.S. Appl. No. 14/990,373 dated Jul. 1, 2016.
Amendment A and Response to Office Action for U.S. Appl. No. 14/990,373 dated Aug. 31, 2016.
Notice of Allowance and Fee(s) Due for U.S. Appl. No. 14/990,373 dated Sep. 13, 20176.
Issue Fee Transmittal Form for U.S. Appl. No. 14/990,373 dated Dec. 9, 2016.
Issue Notification for U.S. Appl. No. 14/990,373 dated Dec. 28, 2016.

SHIPPING AND DISPENSING CARTON

CROSS-REFERENCE TO RELATED APPLICATIONS

This application is a divisional of U.S. application Ser. No. 14/990,373, filed Jan. 7, 2016, which is a continuation application of U.S. application Ser. No. 14/095,136, filed Dec. 3, 2013, which is a divisional of U.S. application Ser. No. 11/549,355, filed Oct. 13, 2006, which claims the benefit of U.S. Provisional Application No. 60/726,408, filed Oct. 13, 2005, and U.S. application Ser. No. 11/549,355 is a continuation-in-part of application Ser. No. 11/524,574, filed Sep. 21, 2006, which claims the benefit of U.S. Application No. 60/719,309, filed Sep. 21, 2005.

INCORPORATION BY REFERENCE

U.S. patent application Ser. No. 14/990,373, which was filed on Jan. 7, 2016, U.S. patent application Ser. No. 14/095,136, which was filed on Dec. 3, 2013, U.S. application Ser. No. 11/549,355, which was filed on Oct. 13, 2006, U.S. Provisional Application No. 60/726,408, which was filed on Oct. 13, 2005, U.S. application Ser. No. 11/524,574, which was filed on Sep. 21, 2006, and U.S. Provisional Application No. 60/719,309, which was filed on Sep. 21, 2005, are hereby incorporated by reference for all purposes as if presented herein in their entirety.

BACKGROUND

Cartons are typically shipped in bulk quantities. During shipping, the cartons may be vertically stacked upon each other in order to maximize the amount of product shipped in a particular vessel. The amount of product shipped may depend, however, on the load-bearing capacity of the stacked cartons. It is therefore desirable to produce cartons having high rigidity and/or strength in compression for shipping, and for other purposes such as the protection of the carton contents in general.

A conventional method for increasing the strength of a carton is to produce the carton from a blank of a different, stronger board material, or to produce the blank from the same carton material but of greater thickness. Such methods typically increase the costs associated with manufacturing the carton, with the material costs of manufacture generally increasing according to the cost of increasing the strength and/or thickness of the entire blank. Some sections of the blank, however, may not be load-bearing, and the additional costs associated with increasing the strength of non-load bearing sections of the blank are wasted.

SUMMARY

In general, one aspect of the disclosure is generally directed to a carton for holding a plurality of articles. The carton comprises a plurality of panels that extends around an interior of the carton. The plurality of panels comprises a first side panel, a bottom panel foldably connected to the first side panel, a second side panel foldably connected to the bottom panel, a first top panel foldably connected to the first side panel, and a second top panel foldably connected to the second side panel. The bottom panel comprises a fold line that divides the bottom panel into a first portion and a second portion foldably connected to the first portion at the fold line. A plurality of end flaps is respectively foldably connected to a respective panel of the plurality of panels and are at least partially overlapped to close an end of the carton. The plurality of end flaps comprises a first proximal side end flap foldably connected to the first side panel, a first distal side end flap foldably connected to the first proximal side end flap, a second proximal side end flap foldably connected to the second side panel, a second distal side end flap foldably connected to the second proximal side end flap, a first bottom end flap foldably connected to the first portion of the bottom panel, and second bottom end flap foldably connected to the second portion of the bottom panel. The first distal side end flap is in face-to-face contact with the second distal side end flap, the first bottom end flap is in face-to-face contact with the first proximal side end flap, and the second bottom end flap is in face-to-face contact with the second proximal side end flap.

In another aspect, the disclosure is generally directed to a blank for forming a carton. The blank comprises a plurality of panels comprising a first side panel, a bottom panel foldably connected to the first side panel, a second side panel foldably connected to the bottom panel, a first top panel foldably connected to the first side panel, and a second top panel foldably connected to the second side panel. The bottom panel comprises a fold line that divides the bottom panel into a first portion and a second portion foldably connected to the first portion at the fold line. A plurality of end flaps are respectively foldably connected to a respective panel of the plurality of panels and are for being at least partially overlapped to close an end of the carton formed from the blank. The plurality of end flaps comprises a first proximal side end flap foldably connected to the first side panel, a first distal side end flap foldably connected to the first proximal side end flap, a second proximal side end flap foldably connected to the second side panel, a second distal side end flap foldably connected to the second proximal side end flap, a first bottom end flap foldably connected to the first portion of the bottom panel, and second bottom end flap foldably connected to the second portion of the bottom panel. The first distal side end flap is positionable to be in face-to-face contact with the second distal side end flap, the first bottom end flap is in face-to-face contact with the first proximal side end flap, and the second bottom end flap is in face-to-face contact with the second proximal side end flap.

In another aspect, the disclosure is generally directed to a method of forming a carton for containing a plurality of articles. The method comprises obtaining a blank comprising a plurality of panels comprising a first side panel, a bottom panel foldably connected to the first side panel, a second side panel foldably connected to the bottom panel, a first top panel foldably connected to the first side panel, and a second top panel foldably connected to the second side panel. The bottom panel comprises a fold line that divides the bottom panel into a first portion and a second portion foldably connected to the first portion at the fold line. The blank comprises a plurality of end flaps respectively foldably connected to a respective panel of the plurality of panels. The plurality of end flaps comprises a first proximal side end flap foldably connected to the first side panel, a first distal side end flap foldably connected to the first proximal side end flap, a second proximal side end flap foldably connected to the second side panel, a second distal side end flap foldably connected to the second proximal side end flap, a first bottom end flap foldably connected to the first portion of the bottom panel, and second bottom end flap foldably connected to the second portion of the bottom panel. The method comprises positioning the plurality of panels to form an interior of the carton and positioning the plurality of end flaps to at least partially close an end of the carton. The positioning the plurality of end flaps comprises positioning the first distal side end flap to be in face-to-face contact with the second distal side end flap, positioning the first bottom end flap to be in face-to-face contact with the first proximal side end flap, and positioning the second bottom end flap to be in face-to-face contact with the second proximal side end flap.

The foregoing and other features, aspects, and advantages of the invention will become more apparent upon review of the detailed description of the preferred embodiments set forth below when taken in conjunction with the accompanying drawing figures, which are briefly described as follows.

BRIEF DESCRIPTION OF THE DRAWING FIGURES

According to common practice, the various features of the drawings discussed below are not necessarily drawn to scale. Dimensions of various features and elements in the drawings may be expanded or reduced to more clearly illustrate the embodiments of the invention.

DETAILED DESCRIPTION

Briefly described, the present invention is directed to cartons having enhanced strength and rigidity. The cartons are formed from primary blanks reinforced with one or more reinforcing blanks adhered to the primary blanks. In this specification, the terms "bottom," "side," and "top" are used to indicate orientations determined in relation to fully erected cartons placed in upright configurations, and are not intended to limit the scope of the invention.

Figure 1A:
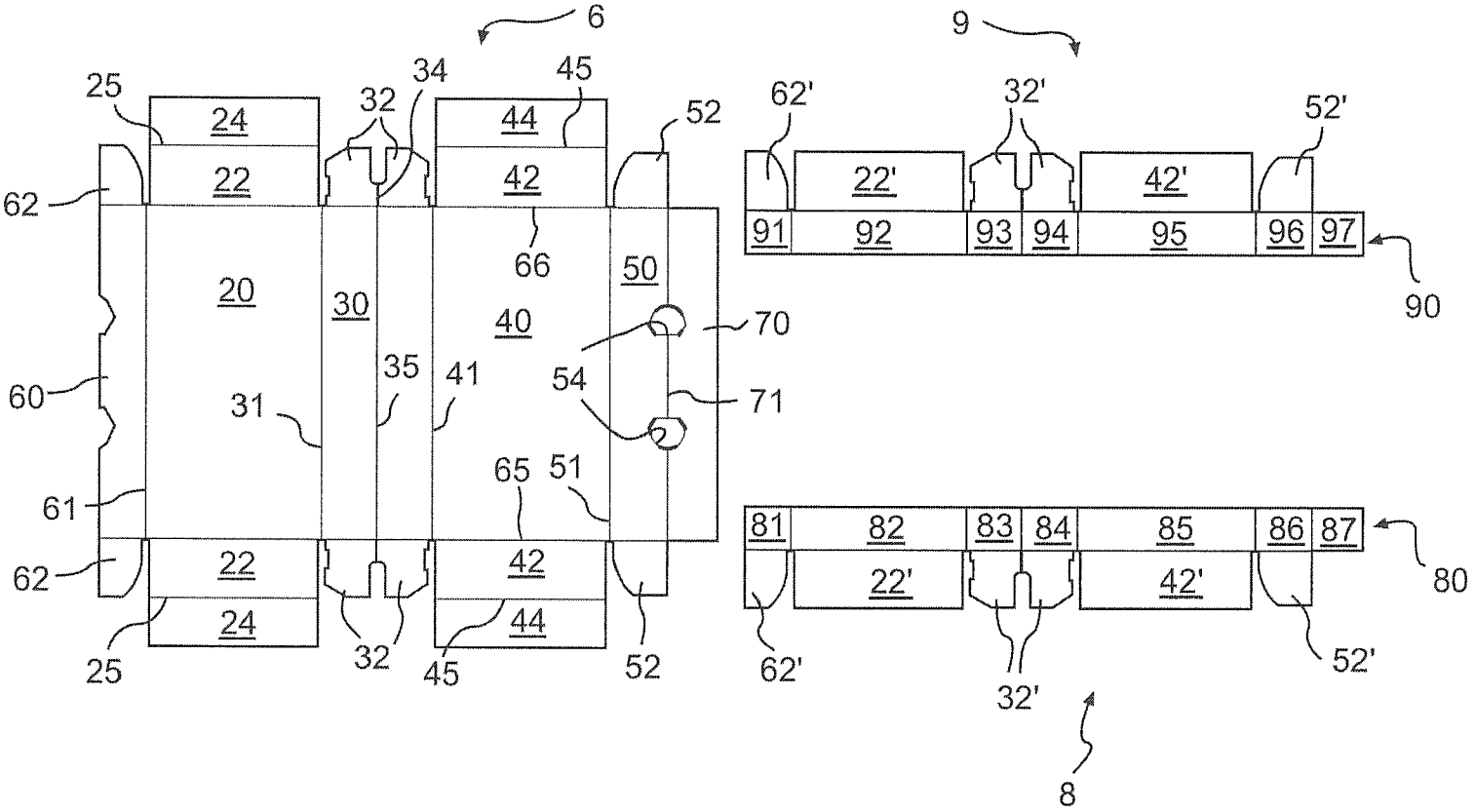
FIG. 1A is a plan view of primary and reinforcing blanks used to form a carton according to a first embodiment of the invention.

FIG. 1A is a plan view of interior sides of a primary blank 6 and first and second reinforcing blanks 8, 9. The blanks 6, 8, 9 are used to form a carton 100 (illustrated in FIGS. 3A and 3B) according to a first embodiment of the invention. The interior sides of the blanks 6, 8, 9 will generally be disposed in the interior of the erected carton 100. The blanks 6, 8, 9 may be combined, for example, into a blank 10 (FIG. 1B) having multi-ply sections formed from adhering the first and second reinforcing blanks 8, 9 to the primary blank 6. As discussed in further detail below, the primary blank 6 can have a periphery that is complementary to portions of the peripheries of the reinforcing blanks 8, 9.

Referring to FIG. 1A, the primary blank 6 comprises a first side panel 20 foldably connected to a bottom panel 30 at a first transversely extending fold line 31, a second side panel 40 foldably connected to the bottom panel 30 at a second transverse fold line 41, and a first top panel 50 foldably connected to the second side panel 40 at a third transverse fold line 41. A second top panel 60 may be foldably connected to the first side panel 20 at a fourth transverse fold line 61, and a third top panel 70 may be foldably connected to the second top panel 50 at a fifth transverse fold line 71. The bottom panel 30 can be foldable at its spine or midpoint at a sixth transverse fold line 35 extending across the width of the bottom panel.

The first side panel 20 is foldably connected at each end to a first proximal side end flap 22, which is connected to a first distal side end flap 24. The bottom panel 30 is foldably connected at each end to two bottom end flaps 32. The bottom end flaps 32 are separated by transversely extending cuts 34. The second side panel 40 is foldably connected at each end to a second proximal side end flap 42, which is connected to a second distal side end flap 44. The first top panel 50 is foldably connected at each end to a first top end flap 52. The second top panel 60 is foldably connected at each end to a second top end flap 62. Handle apertures or knockouts 54 may be formed in one or both of the first and third top panels 50, 70. The end flaps 22, 24, 32, 42, 44, 52, 62 extend along a first and a second marginal area of the blank 6, and may be connected at first and second longitudinally extending fold lines 65, 66. The longitudinal fold lines 65, 66 may be straight, or they may be offset at one or more locations to account for, for example, blank thickness. The first side end flaps 22, 24 are foldably connected at longitudinal fold lines 25, and the second side end flaps 42, 44 are foldably connected at longitudinal fold lines 45.

The first reinforcing blank 8 has a perimeter that may be in part generally complementary to a part of the first marginal area of the primary blank 6. The first reinforcing blank 8 is meant to overlie a part of the first marginal area of the primary blank 6 in order to reinforce the blank 6. The first reinforcing blank 8 includes a strip 80 of sequentially arranged rectangular reinforcing panels 81, 82, 83, 84, 85, 86, 87, and foldably attached reinforcing end flaps 62', 22', 32', 32', 42', 52'. During erection, the blank 8 is placed over the primary blank 6 so that the reinforcing end flaps 62', 22', 32', 32', 42', 52' of the first reinforcing blank 8 overlie and generally conform in shape to corresponding end flaps 62, 22, 32, 32, 42, 52, respectively, of the primary blank 6. The sequentially arranged reinforcing panels 81, 82, 83, 84, 85, 86, 87 are aligned with respective panels 60, 20, 30, 40, 50, 70 of the primary blank 6 so that the reinforcing blank 9 folds along the transverse fold lines 61, 31, 35, 41, 51, 71 in the primary blank 6.

Similarly, the second reinforcing blank 9 has a shape that may be in part generally complementary to a part of the second marginal area of the primary blank 6, and is meant to overlie and reinforce a second part of the first blank 6. The second reinforcing blank 9 includes a strip 90 of sequentially arranged rectangular reinforcing panels 91, 92, 93, 94, 95, 96, 97, and reinforcing end flaps 62', 22', 32', 32', 42', 52'. During erection, the second reinforcing blank 9 is placed over the primary blank 6 so that the reinforcing end flaps 62', 22', 32', 32', 42', 52' of the reinforcing blank 9 overlie and generally conform in shape to the end flaps 62, 22, 32, 32, 42, 52 of the primary blank 6. The reinforcing panels 91, 92, 93, 94, 95, 96, 97 are aligned with respective panels 60, 20, 30, 40, 50, 70 of the primary blank 6 so that the second reinforcing blank 9 folds along the transverse fold lines 61, 31, 35, 41, 51, 71 of the primary blank 6. Portions of the second reinforcing blank 9 may be, for example, a mirror image of the first reinforcing blank 8, and certain common reference numerals are therefore used in the reinforcing blanks 8 and 9.

Figure 1B:
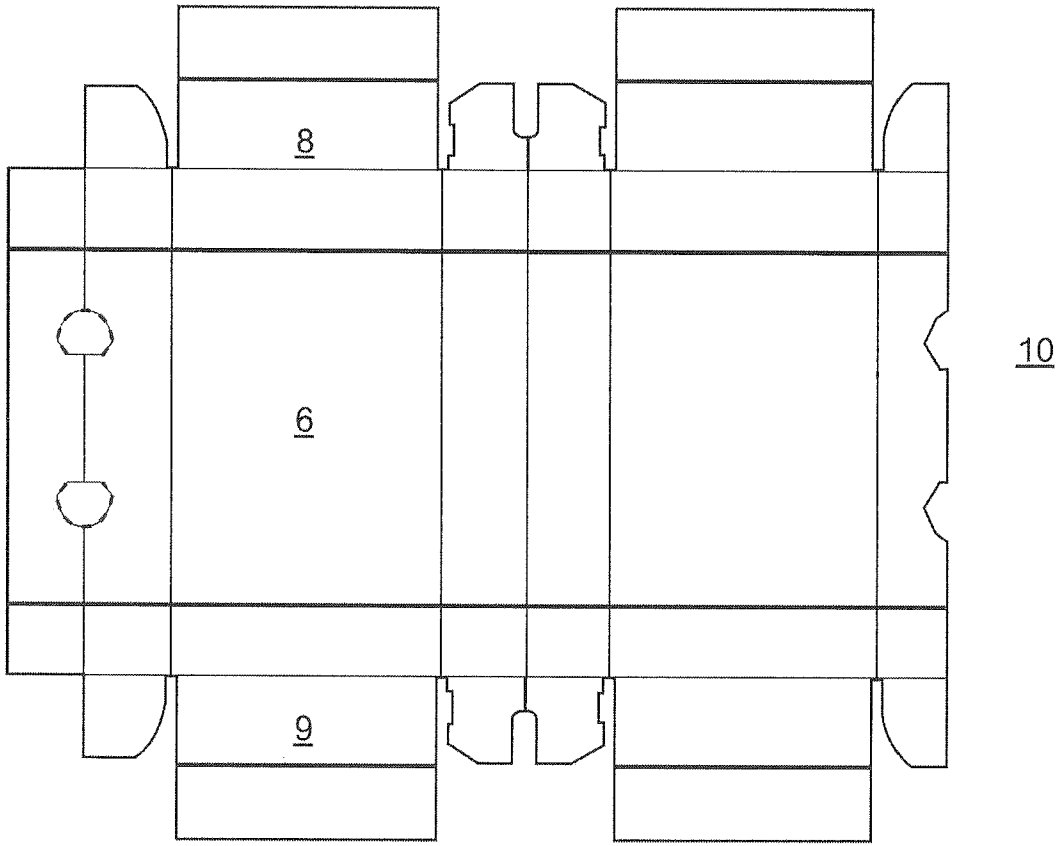
FIG. 1B illustrates the blanks of FIG. 1A combined into a multi-ply blank.

FIG. 1B illustrates the primary blank 6 and the reinforcing blanks 8, 9 combined into a multi-ply blank 10. In FIG. 1B, the reinforcing blanks 8, 9 are placed over the respective first and second marginal areas of the primary blank 6 and secured thereto 6. The first and second distal side end flaps 24, 44 at each end of the primary blank 6 extend beyond the edges of the reinforcing blanks 8, 9. Glue, for example, or other adhesives, or other means, may be used to secure the reinforcing blanks 8, 9 to the primary blank.

Figure 2A:
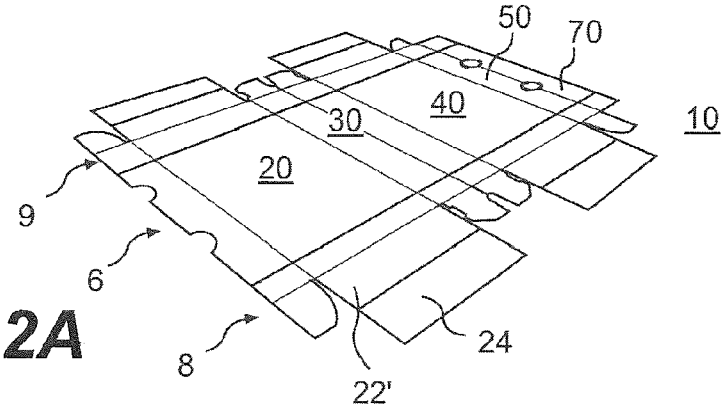
FIGS. 2A-2E illustrate erection of the first carton embodiment from the blank of FIG. 1B.
Figure 2B:
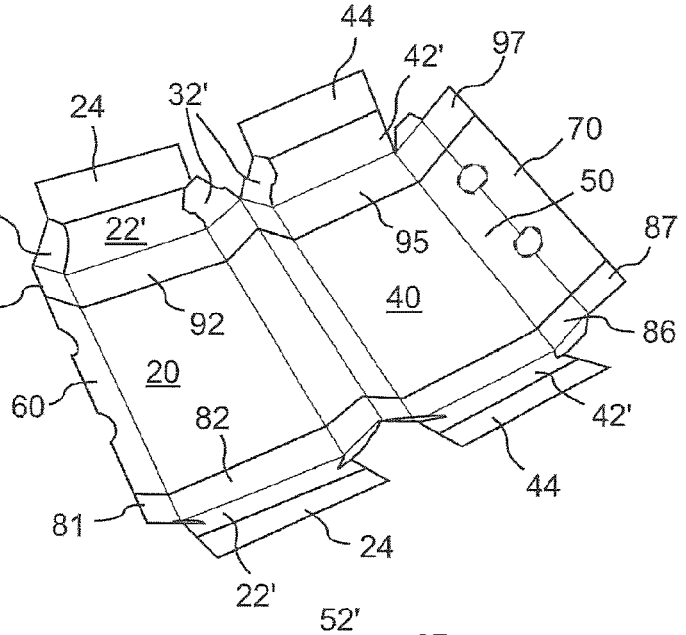
Figure 2C:
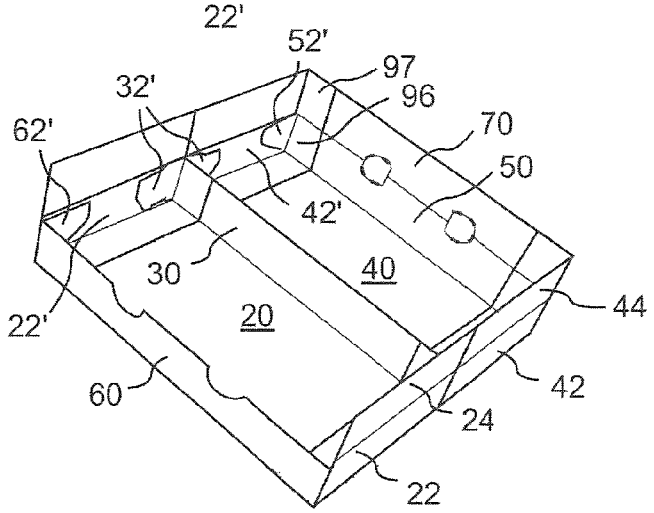
Figure 2D:
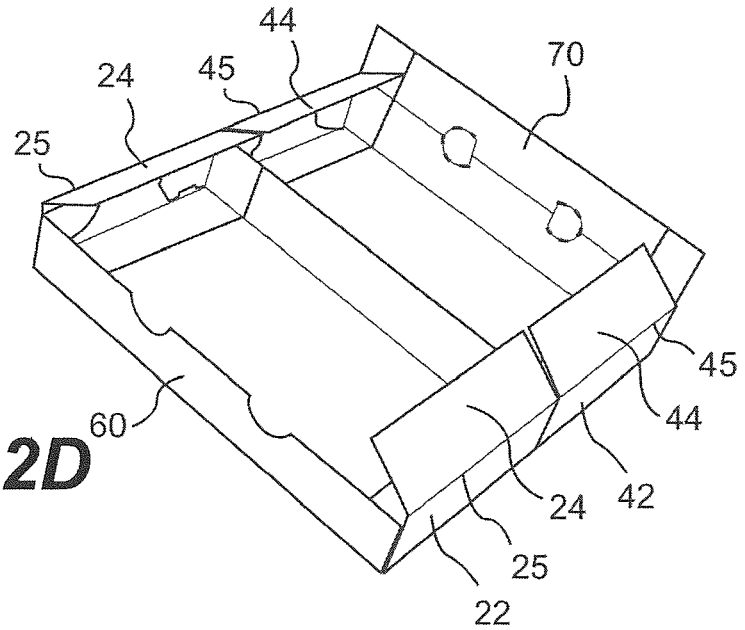
Figure 2E:
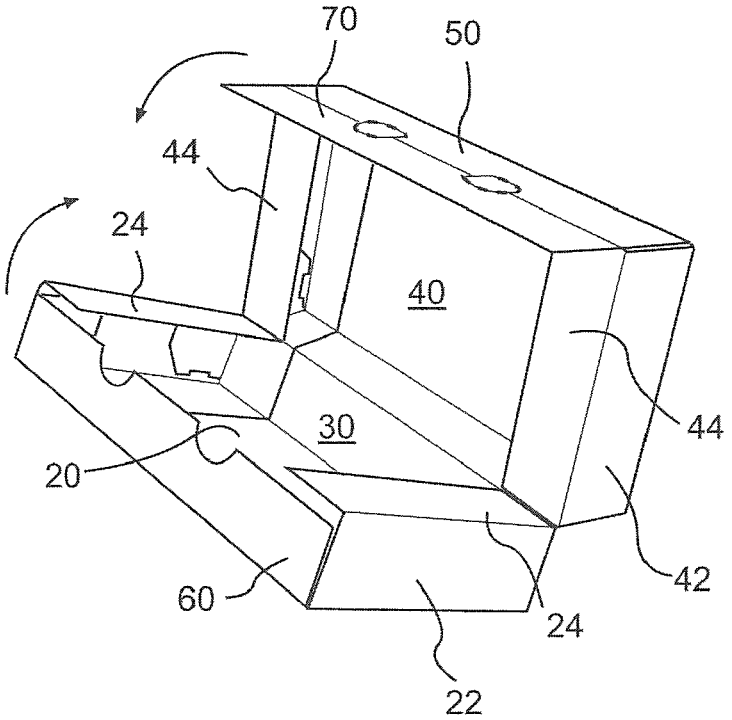
Figure 3A:
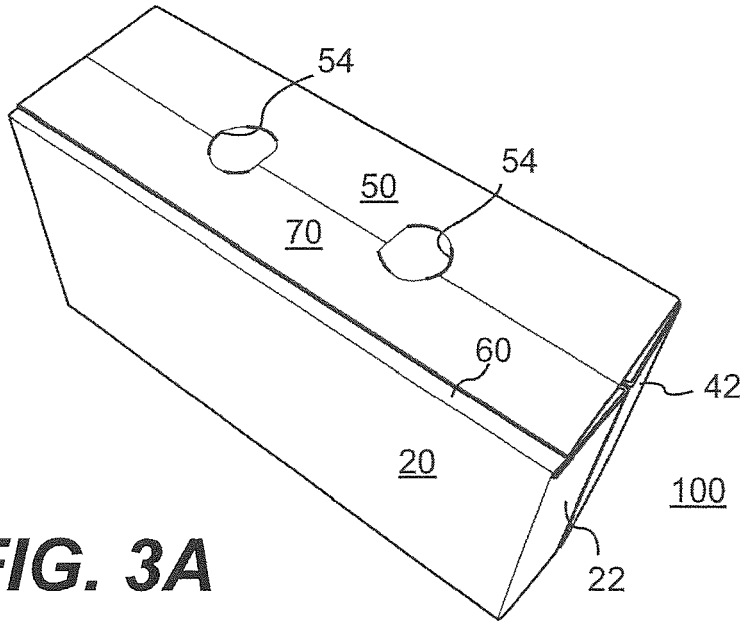
FIGS. 3A and 3B illustrate the first carton embodiment.
Figure 3B:
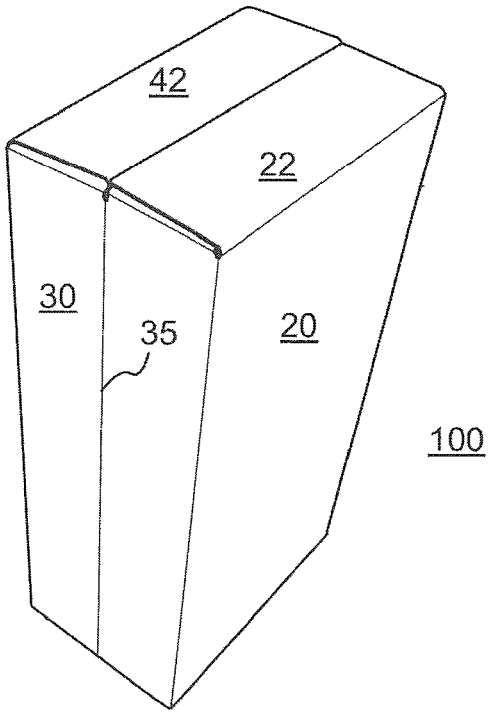

FIGS. 2A-2E illustrate erection of the multi-ply blank 10 into the carton 100. Certain elements of the blanks 6, 8, 9 referred to in the following description may not be visible in FIGS. 2A-2E, and such elements can be found in FIGS. 1A and 1B. FIG. 2A illustrates the multi-ply blank 10 ready for erection. In FIG. 2B, the end flaps 22, 24, 32, 32, 42, 44, 52, 62 (along with the reinforcing end flaps 62', 22', 32', 32', 42', 52') and the top panels 50, 60, 70 are folded inwardly. In FIG. 2C, the exterior sides of the end flaps 62, 32 are adhered to the interior sides of the reinforcing end flaps 22', and the exterior sides of the end flaps 32 and 52 are adhered to the interior sides of the reinforcing end flaps 42'. In FIG. 2D, the first and second side distal end flaps 24, 44 are folded inwardly until they are generally parallel to the first and second side panels 20, 40, respectively. FIG. 2E illustrates the partially erected blank 10 being folded in the direction of the arrows to bring the opposed halves of the partially erected carton together. The opposed distal side end flaps 24, 44 may optionally be adhered together, if desired. The interior side of the third top panel 70 may be adhered to the exterior side of the second stop panel 60 to complete erection of the carton 100, as shown in FIGS. 3A and 3B. Articles (not shown) may be loaded into the carton 100 at any time prior to fully closing the carton 100.

FIGS. 3A and 3B illustrate the erected carton 100. The carton 100 may be, for example, generally parallelepipedal, and may have a closed or nearly closed configuration. In FIG. 3A, the carton 100 rests on the bottom panel 30. The first and second proximal side end flaps 22, 42 along with the reinforcing end flaps 22', 42' adhered thereto close the ends of the carton 100. The handle apertures 54 are accessible in the top panels 50, 70.

Figure 4A:
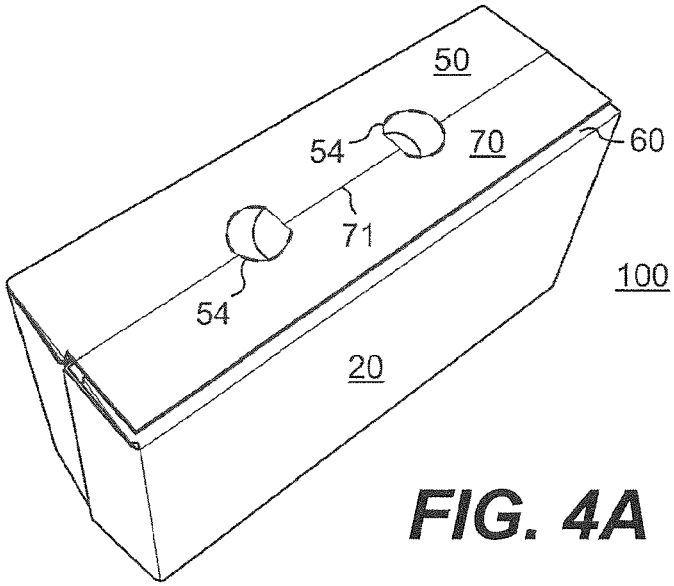
FIG. 4A illustrates the first carton embodiment with its handles accessed.
Figure 4B:
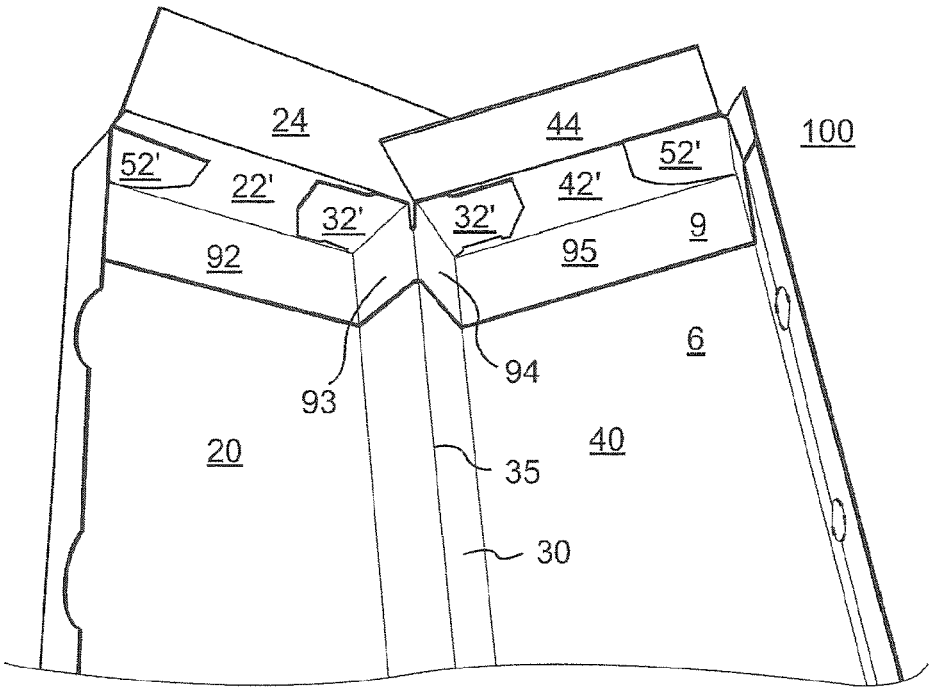
FIG. 4B illustrates the first carton embodiment after opening the carton.

FIG. 4A illustrates the erected carton 100 with the handle apertures 54 accessed. FIG. 4B illustrates a portion of the interior of the carton 100 with the carton 100 fully opened. The carton 100 can be opened, for example, by separating the attachment of the third top panel 70 to the second top panel 60. FIG. 4B illustrates the reinforcing configuration of the reinforcing blank 9 in the carton 100. The reinforcing blank 9, as well as the reinforcing blank 8 (illustrated in FIG. 1A), provides additional strength and rigidity to the carton 100. For example, when the carton 100 is supported on the bottom panel 30 as shown in FIG. 4A, the panels and flaps 92, 95, 22', 42' of the reinforcing blank 9, and the reinforcing panels and flaps 82, 85, 22', 42' of the reinforcing blank 8 extend vertically within the carton 100 interior and provide significant strength against vertical axial compression. Similarly, if the carton 100 is supported on either of its side panels 20, 40, the first and second reinforcing blanks 8, 9 provide significant additional axial compressive strength and rigidity to the primary blank 6.

Figure 5:
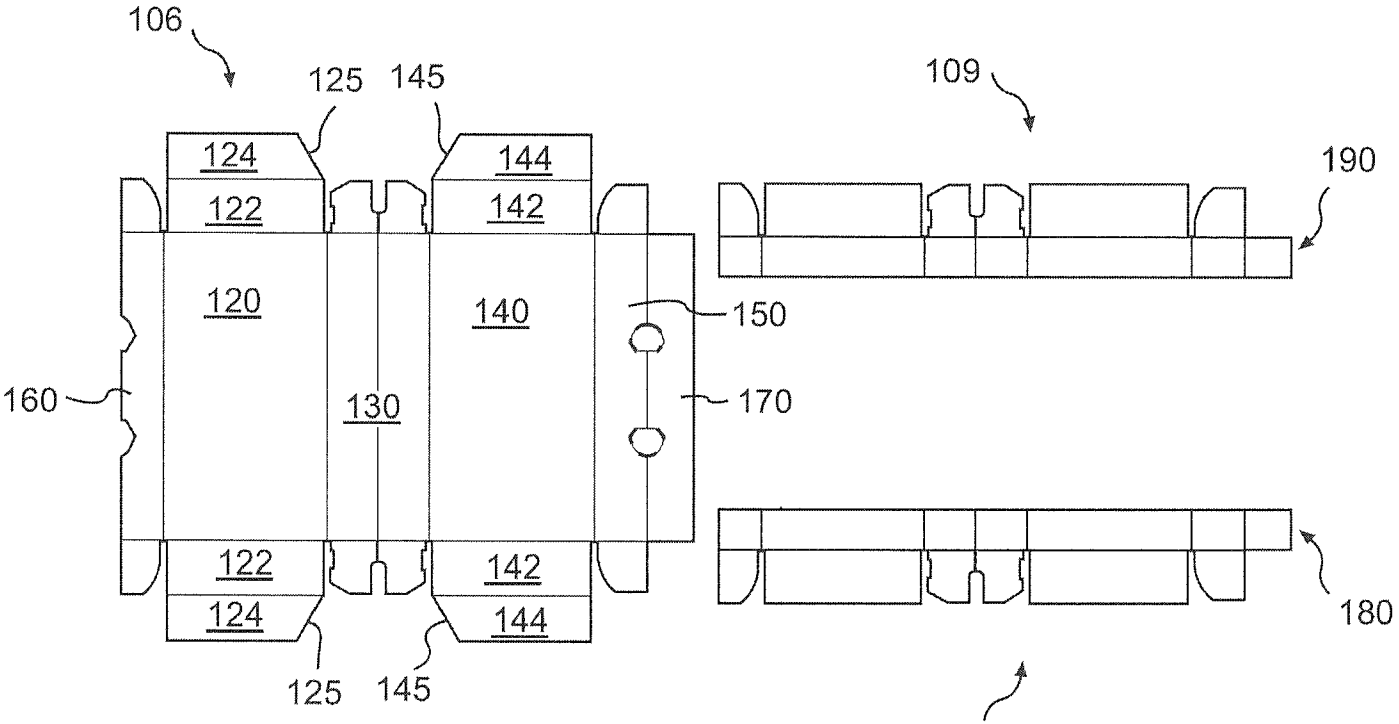
FIG. 5 is a plan view of primary and reinforcing blanks used to form a carton according to a second embodiment of the invention.

FIG. 5 illustrates a primary blank 106 and first and second reinforcing blanks 108, 109 according to a second embodiment of the invention. In FIG. 5, like reference numbers to the reference numbers shown in FIG. 1A indicate like or similar elements, with the reference numbers in FIG. 5 being preceded by "1." A resultant multi-ply blank formed from the primary and reinforcing blanks 106, 108, 109 can be erected into a carton using the method shown in FIGS. 2A-2E. The primary blank 106 is substantially identical to the primary blank 6, except the first and second distal side end flaps 124, 144 include beveled or truncated corners 125, 145, respectively. The beveled corners 125, 145, may, for example, provide ease of folding of the distal side end flaps 124, 144, respectively during erection. The corners may be, for example, truncated with alternative cut patterns, such as arcuate or curved patterns.

Figure 6A:
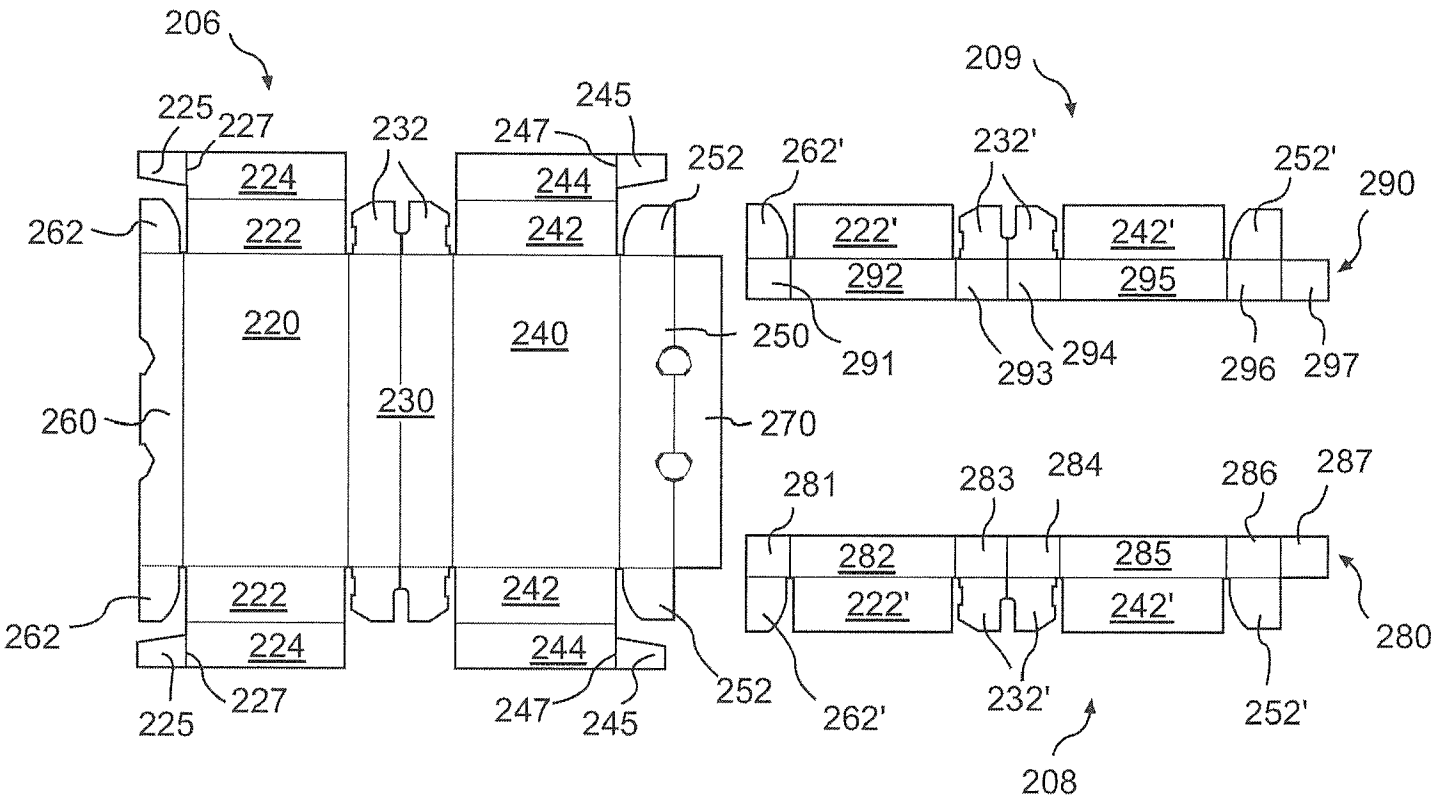
FIG. 6A is a plan view of primary and reinforcing blanks used to form a carton according to a third embodiment of the invention.
Figure 6B:
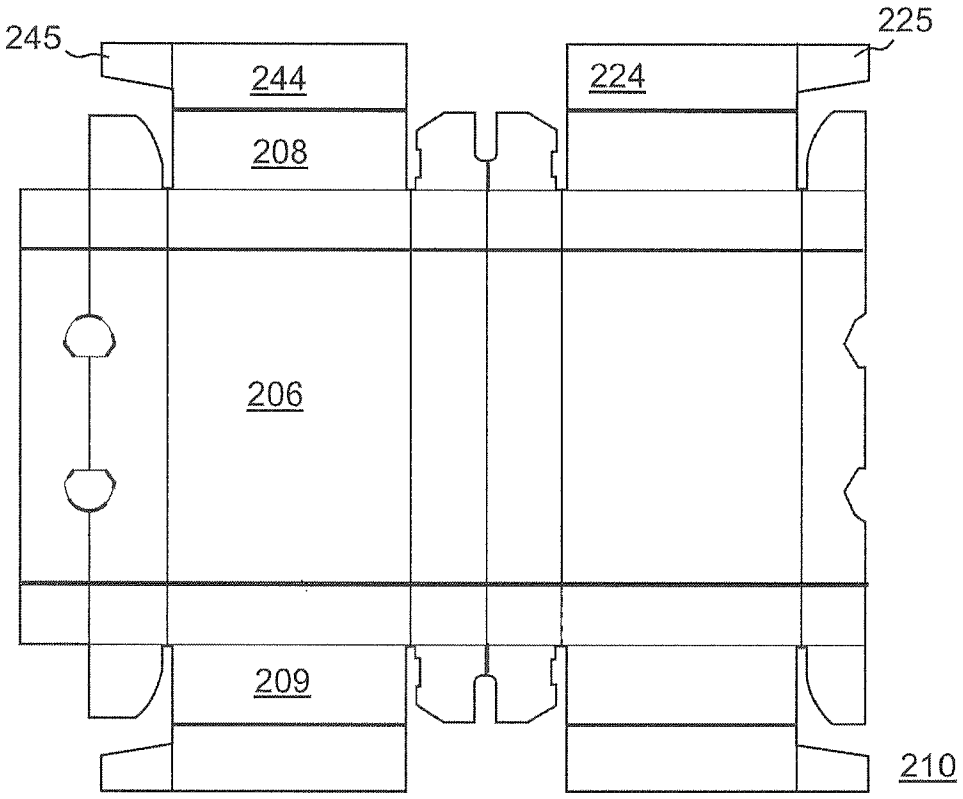
FIG. 6B illustrates the blanks of FIG. 6A combined into a multi-ply blank.

FIG. 6A is a plan view of a primary blank 206 and first and second reinforcing blanks 208, 209 used to form a carton 300 (illustrated in FIG. 8) according to a third embodiment of the invention. The primary blank 205 is substantially identical to the primary blank 6 shown in FIG. 1A, except the first and second side distal end flaps 224, 244 include first and second extensions 225, 245, respectively. In FIGS. 6A-8, like reference numbers to the reference numbers shown in FIG. 1A indicate like or similar elements, with the reference numbers in FIGS. 6A-8 being preceded by "2." FIG. 6B illustrates a multi-ply blank 210 formed by adhering the first and second reinforcing blanks 208, 209 to the primary blank 206.

Figure 7A:
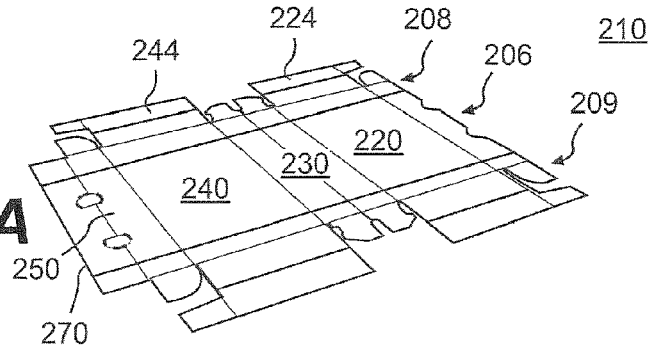
FIGS. 7A-7E illustrate erection of the third carton embodiment.
Figure 7B:
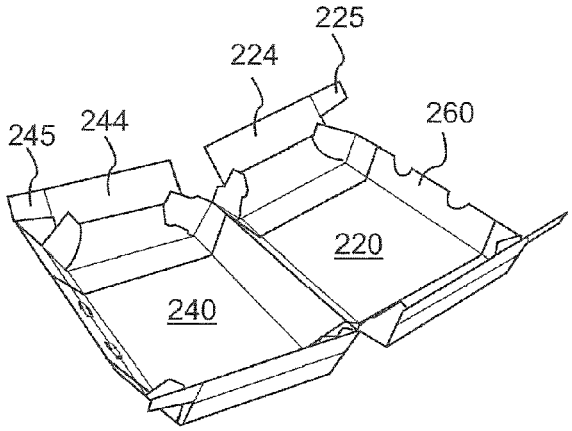
Figure 7C:
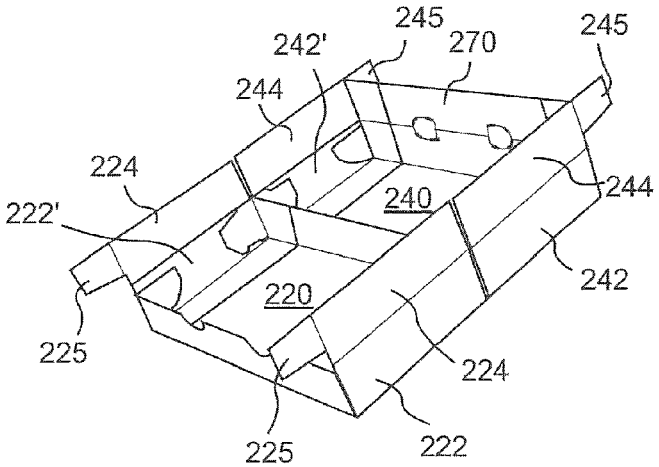
Figure 7D:
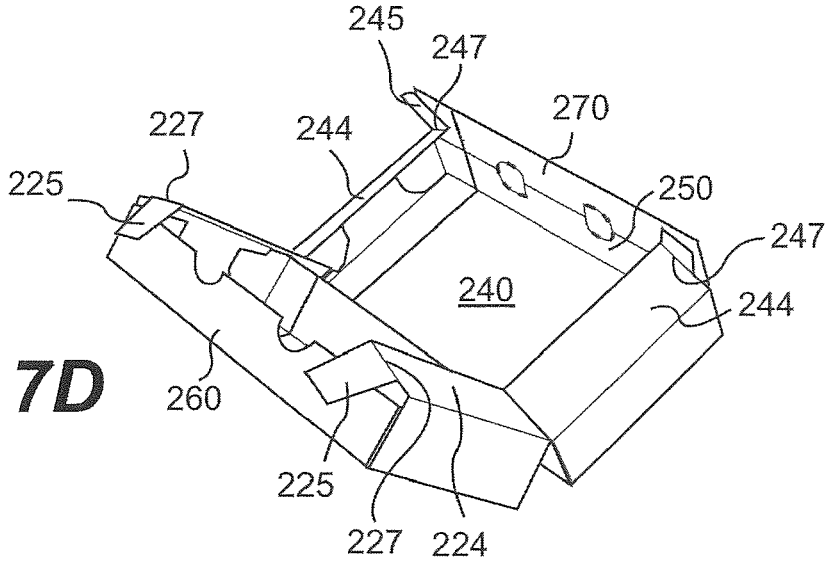

FIGS. 7A-7E illustrate erection of the multi-ply blank 210 into the carton 300. Certain elements of the blanks 206, 208, 209 may not be visible in FIGS. 7A-7E, and such elements can be found in FIGS. 6A and 6B. In FIG. 7B, the end flaps 222, 224, 232, 232, 242, 244, 252, 262 (along with the reinforcing flaps 262', 222', 232', 232', 242', 252') and the top panels 250, 260, 270 are folded inwardly. In FIG. 7C, the exterior sides of the end flaps 262, 232 are adhered to the interior sides of the reinforcing side end flaps 222', and the exterior sides of the end flaps 232 and 252 are adhered to the interior sides of the reinforcing side end flaps 242'. In FIG. 7D, the first and second side distal end flaps 224, 244 are folded inwardly. The second extensions 245 are folded upwardly about their respective fold lines 247 so that they abut the interior side of the third top panel 270. If desired, the second extensions 245 may be adhered to the third top panel 270. The first extensions 225 are folded about their respective fold lines 227 so that they overlap the exterior side of the second top panel 260. If desired, the first extensions 225 may be adhered to the second top panel 260.

Figure 7E:
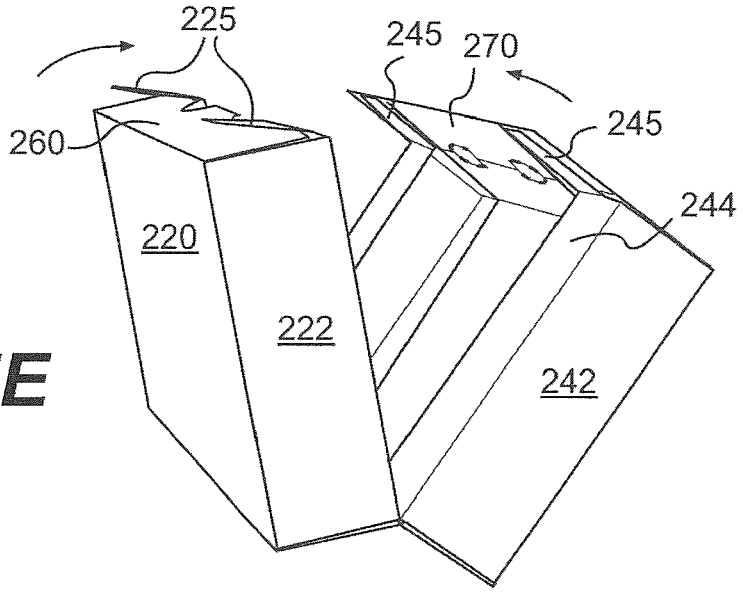
Figure 8:
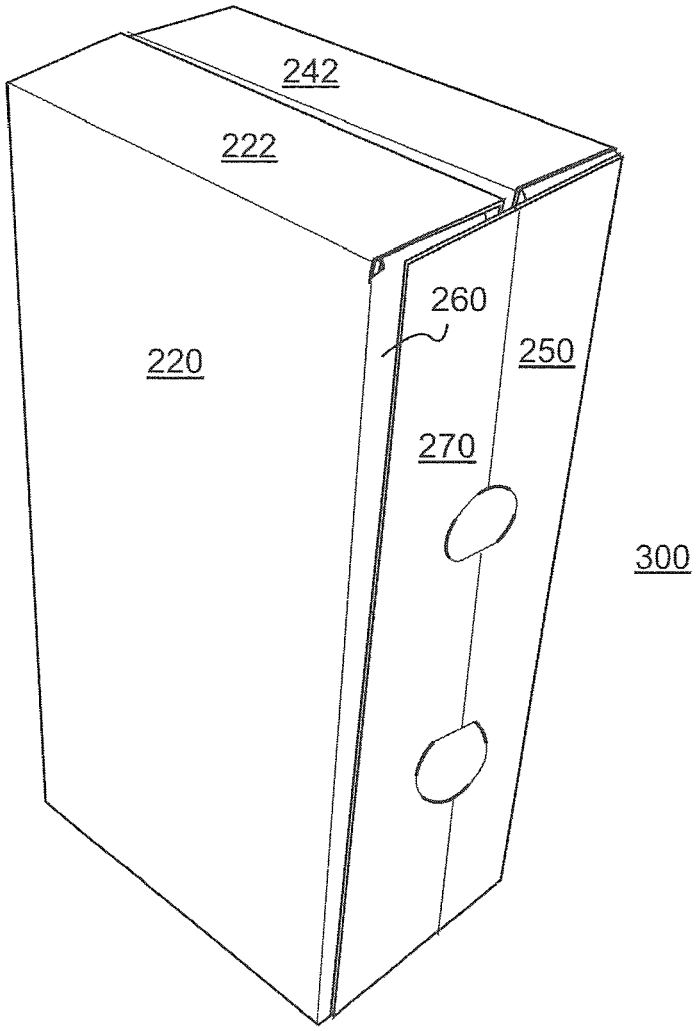
FIG. 8 illustrates the third carton embodiment.

FIG. 7E illustrates the partially erected blank 210 being folded to bring the opposed halves of the partially erected carton together. The opposed first and second distal side end flaps 224, 244 at one or both ends of the carton may be adhered together, if desired. The interior side of the third top panel 270 may be adhered to the exterior side of the second stop panel 260 to complete erection of the carton 300. The erected carton 300 is illustrated in FIG. 8. Articles (not shown) may be placed in the carton 300 at any time prior to fully closing the carton 300. In the carton 300, adhering the first and second extensions 225, 245 to the respective top panels 260, 270 maintains the distal side end flaps 224, 244 in the carton interior such that that they are generally parallel to the first and second side panels 220, 240.

Figure 9A:
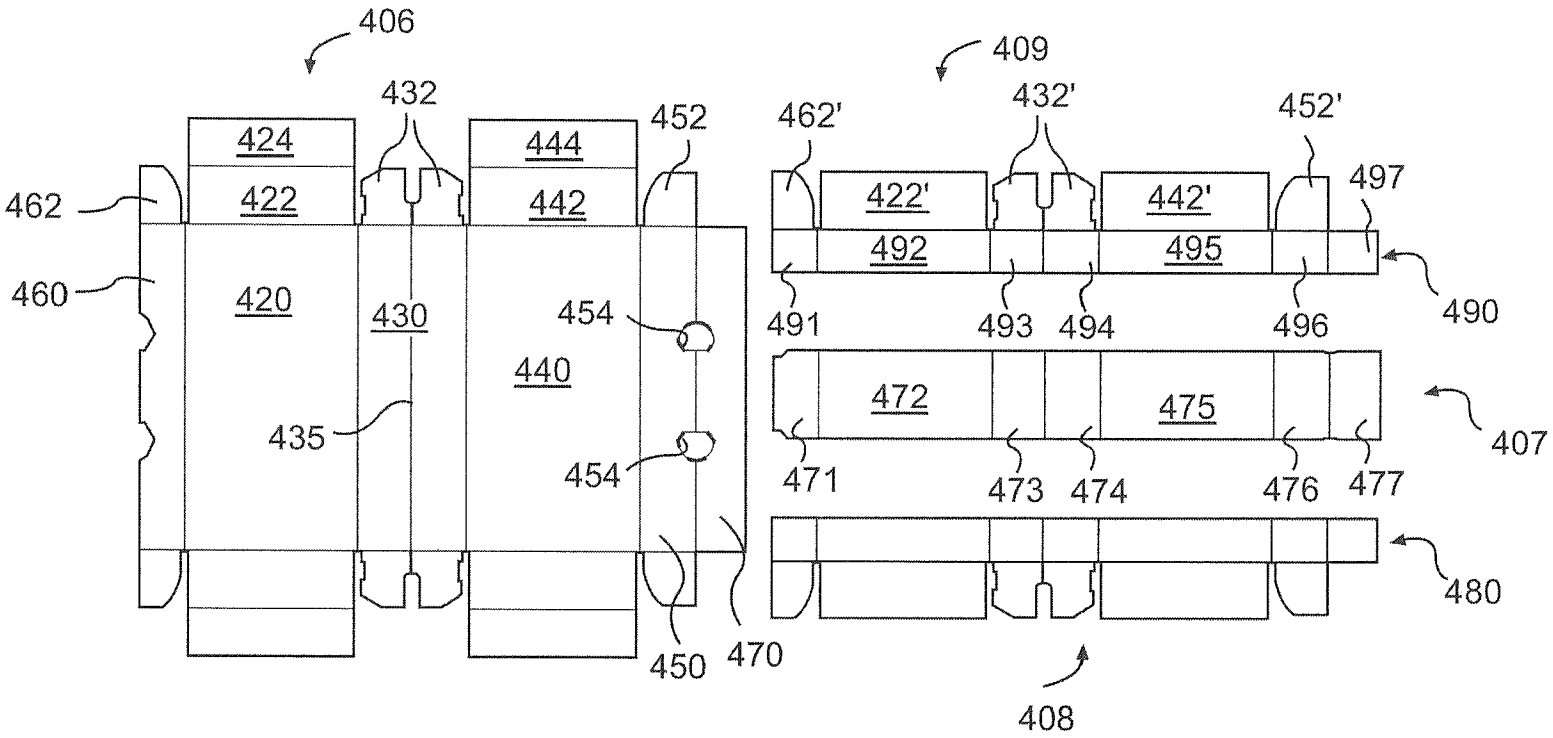
FIG. 9A is a plan view of primary and reinforcing blanks used to form a carton according to a fourth embodiment of the invention.

FIG. 9A illustrates a primary blank 406 and first, second and third reinforcing blanks 408, 409, 407 for forming a carton 500 (illustrated in FIG. 10) according to a fourth embodiment of the invention. In FIG. 9A, like reference numbers to the reference numbers shown in FIG. 1A indicate like or similar elements, with the reference numbers in FIG. 9A being preceded by "4." The primary blank 406 and the first and second reinforcing blanks 408, 409 may be substantially identical to the blanks 6, 8, 9, respectively.

Figure 9B:
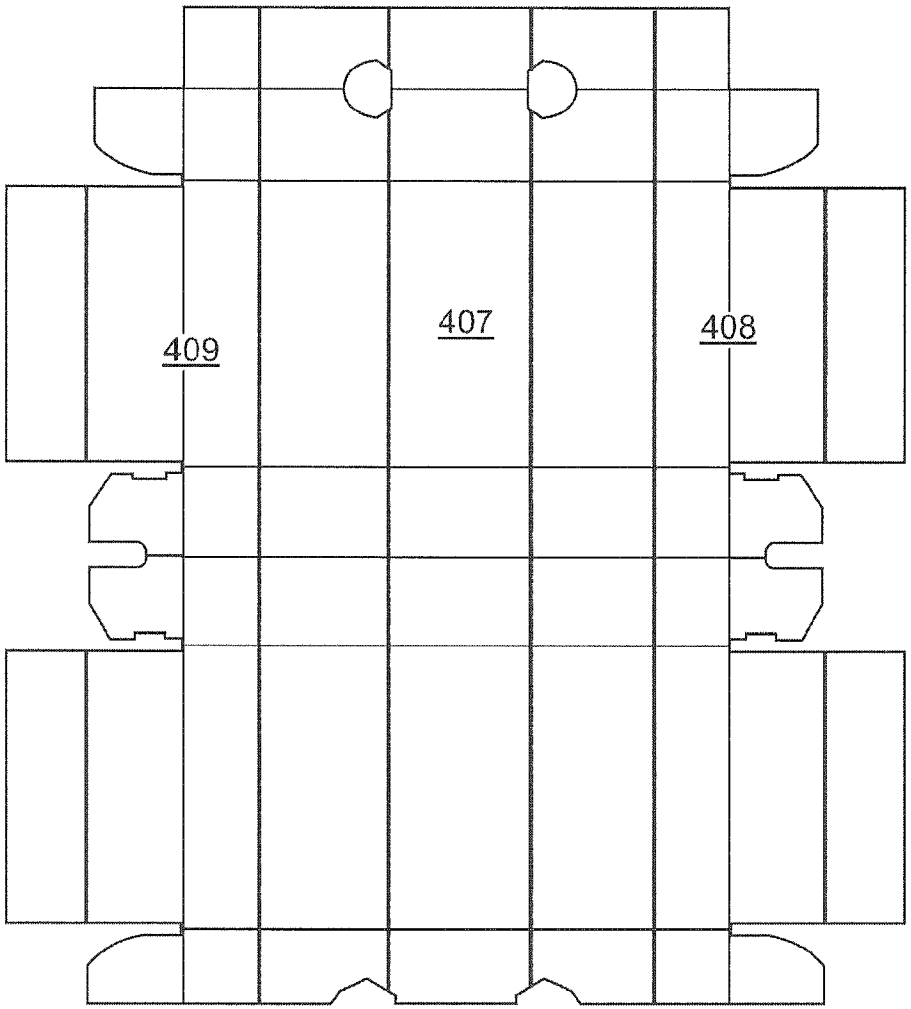
FIG. 9B illustrates the blanks of FIG. 9A combined into a multi-ply blank.

The third reinforcing blank 407 is designed to overlie and reinforce a central section of primary blank 406. The third reinforcing blank 407 comprises a series of sequentially arranged reinforcing panels 471, 472, 473, 474, 475, 476, 477. During erection, the third reinforcing blank 407 is placed over the primary blank 406 so that the reinforcing panels 471, 472, 473, 474, 475, 476, 477 overlie and are adhered to the panels 460, 420, 430, 440, 450, 470 of the primary blank 460. The resultant multi-ply blank 410 formed from the blanks 406, 407, 408, 409 is shown in FIG. 9B. In FIG. 9B, the third reinforcing blank 407 is centrally located between the first and second reinforcing blanks 408, 409, although other orientations are possible.

Figure 10:
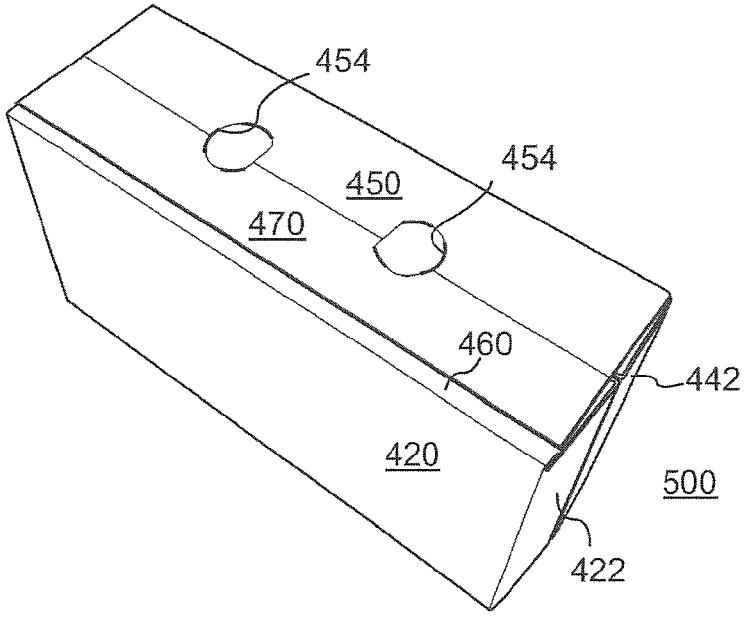
FIG. 10 illustrates the fourth carton embodiment.
Figure 11:
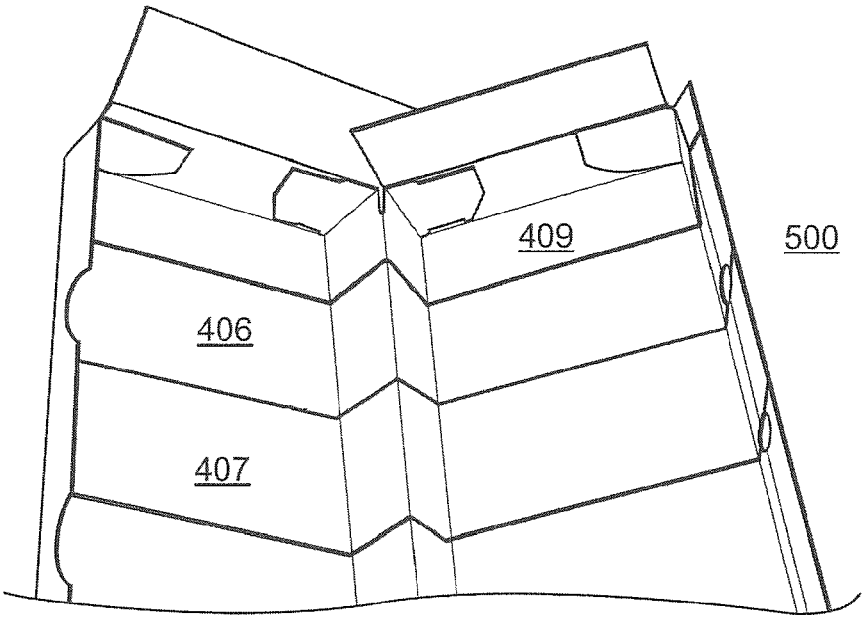
FIG. 11 illustrates the fourth carton embodiment after opening the carton.

Referring to FIG. 9B, the multi-ply blank 410 can be erected into a carton using the method shown in FIGS. 2A-2E. FIG. 10 illustrates the carton 500 erected from the blank 410. FIG. 11 illustrates the carton 500 after opening, and shows the position of the reinforcing blanks 407, 409 in the erected carton.

FIGS. 12A-12E illustrate an alternative method of erecting the blank 10 illustrated in FIG. 1B into a carton. The method shown in FIGS. 12A-12E is essentially identical to the method shown in FIGS. 2A-2E, except that in FIG. 12B, the first and second distal side end flaps 24, 44 are folded over flat about the longitudinal fold lines 25, 45, respectively. The interior sides of the distal side end flaps 24, 44 are then in a position to be adhered to the interior sides of the reinforcing end flaps 22', 42', respectively.

Figure 12A:
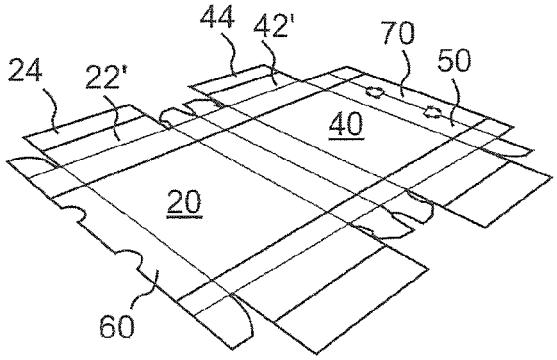
FIGS. 12A-12E illustrate an alternative method of erecting the multi-ply blank of FIG. 1B into a carton.
Figure 12B:
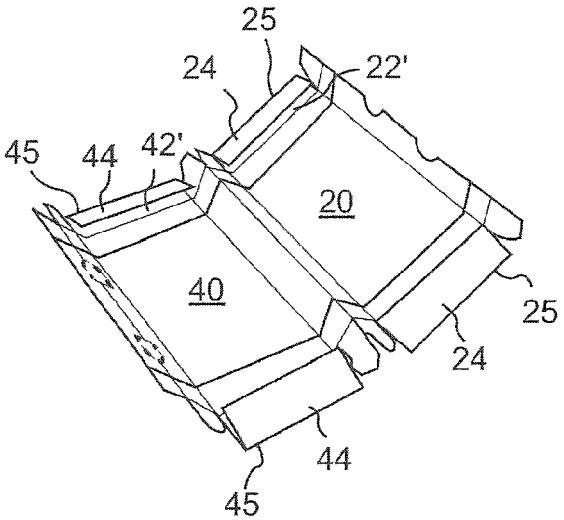
Figure 12C:
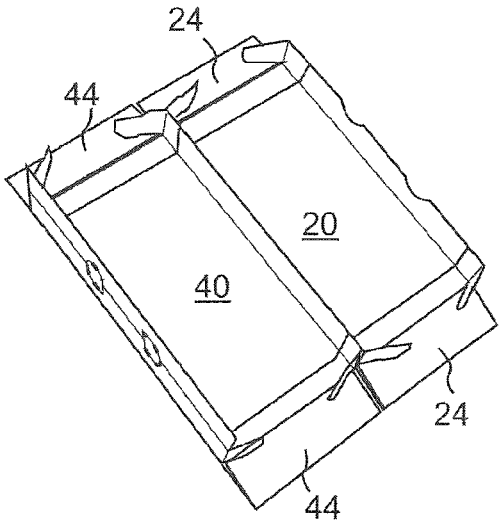
Figure 12D:
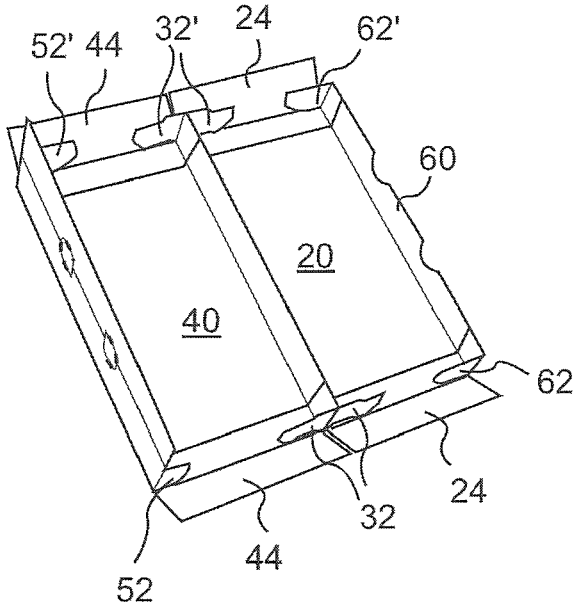
Figure 12E:
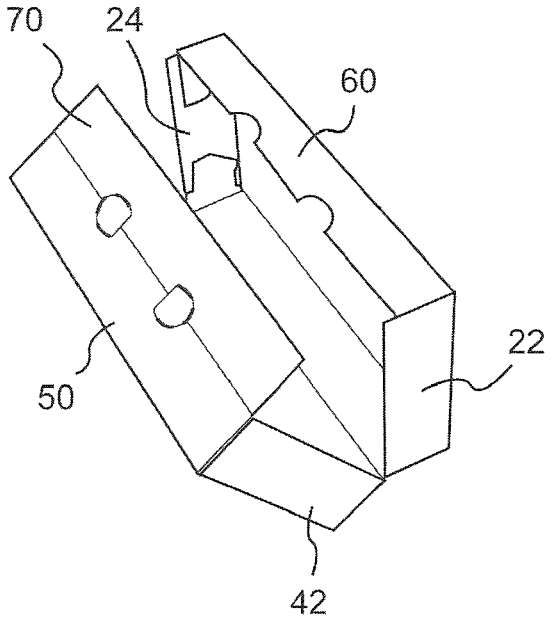

Referring to FIGS. 12C and 12D, the exterior sides of the end flaps 32, 52 may be adhered to the second distal side end flaps 44, and the exterior sides of the end flaps 32, 62 may be adhered to the first distal side end flaps 24. FIG. 12E illustrates closing of the opposite sides of the carton so that the third top panel 70 can be adhered to the second top panel 60.

According to the above embodiments, a primary blank can be reinforced at selected locations by reinforcing blanks. The carton formed from the resulting multi-ply blank can accordingly have enhanced strength and rigidity at selected sections of the carton. According to the present invention, selected reinforcement of specific areas of the primary blank can produce a high strength carton while using relatively small amounts of board.

One or more of the reinforcing blanks discussed above may be omitted in the above embodiments, for example, if a lesser amount of reinforcement is sufficient for a particular application.

In accordance with the exemplary embodiments, the cartons may be constructed of paperboard, for example. The blanks, and thus the cartons, can also be constructed of other materials, such as cardboard, solid unbleached sulfate (SUS) board, or any other material having properties suitable for enabling the carton to function at least generally as described above.

In one exemplary embodiment, the primary and reinforcing blanks are formed from SUS board. The primary blank has a caliper in the range of about 14-30 point, which may be more specifically in the range of about 18-26 point. The caliper of the reinforcing blanks can be slightly less than the primary blank, and can be in the range of about 14-20 point.

The blanks can also be laminated to or coated with one or more additional sheet-like materials at selected panels or panel sections. One or more panels of the blanks discussed above can be coated with varnish, clay, or other materials, either alone or in combination. The coating may then be printed over with product, advertising, and other information or images. The blanks may also be coated to protect any information printed on the blanks. The blanks may be coated with, for example, a moisture barrier layer, on either or both sides of the blanks.

In accordance with the above-described embodiments of the present invention, a fold line can be any substantially linear, although not necessarily straight, line of disruption or other form of weakening that facilitates folding therealong.

In the present specification, a "panel" or "flap" need not be flat or otherwise planar. A "panel" or "flap" can, for example, comprise a plurality of interconnected generally flat or planar sections.

The above embodiments may be described as having one or more panels adhered together by glue. The term "glue" is intended to encompass all manner of adhesives commonly used to secure carton panels in place.

The foregoing description of the invention illustrates and describes the present invention. Additionally, the disclosure shows and describes only selected embodiments of the invention, but it is to be understood that the invention is capable of use in various other combinations, modifications, and environments and is capable of changes or modifications within the scope of the inventive concept as expressed herein, commensurate with the above teachings, and/or within the skill or knowledge of the relevant art.

What is claimed is:

1. A blank for forming a carton, the blank comprising:

a plurality of panels comprising a first side panel, a bottom panel foldably connected to the first side panel, a second side panel foldably connected to the bottom panel, a first top panel foldably connected to the second side panel, and a second top panel foldably connected to the first side panel, the bottom panel comprises a fold line that divides the bottom panel into a first portion and a second portion foldably connected to the first portion at the fold line; and a plurality of end flaps respectively foldably connected to a respective panel of the plurality of panels and for being at least partially overlapped to close an end of the carton formed from the blank, the plurality of end flaps comprises a first proximal side end flap foldably connected to the first side panel, a first distal side end flap foldably connected to the first proximal side end flap, a second proximal side end flap foldably connected to the second side panel, a second distal side end flap foldably connected to the second proximal side end flap, a first bottom end flap foldably connected to the first portion of the bottom panel, and second bottom end flap foldably connected to the second portion of the bottom panel, the first distal side end flap is folded relative to the first proximal side end flap to be generally parallel to the first side panel, and the second distal side end flap is folded relative to the second proximal side end flap to be generally parallel to the second side panel.

2. The blank of claim 1, wherein the first bottom end flap is in face-to-face contact with the first proximal side end flap.

3. The blank of claim 2, wherein the second bottom end flap is in face-to-face contact with the second proximal side end flap.

4. The blank of claim 1, wherein the first bottom end flap and the second bottom end flap are separated by a cut.

5. The blank of claim 4, wherein the cut is aligned with the fold line.

6. The blank of claim 1, wherein the first distal side end flap is for being in face-to-face contact with the second distal side end flap in the carton formed from the blank.

7. The blank of claim 6, wherein the first distal side end flap is adhesively attached to the second distal side end flap.

8. The blank of claim 1, wherein the plurality of end flaps comprises a first top end flap foldably connected to the first top panel and a second top end flap foldably connected to the second top panel.

9. The blank of claim 8, wherein the first top end flap is in face-to-face contact with the second proximal side end flap.

10. The blank of claim 9, wherein the second top end flap is in face-to-face contact with the first proximal side end flap.

11. The blank of claim 10, wherein the plurality of panels comprises a third top panel foldably connected to the first top panel.

12. The blank of claim 10, wherein the second top panel is folded relative to the first side panel to be generally perpendicular to the first side panel.

13. The blank of claim 12, wherein the third top panel is for being in face-to-face contact with the second top panel in the carton formed from the blank.

14. The blank of claim 12, wherein the first top panel is folded relative to the second side panel to be generally perpendicular to the second side panel.

15. The blank of claim 14, wherein the third top panel is generally coplanar with the second top panel.

* * * * *